US007190315B2

(12) United States Patent
Waltho

(10) Patent No.: US 7,190,315 B2
(45) Date of Patent: Mar. 13, 2007

(54) FREQUENCY SELECTIVE SURFACE TO SUPPRESS SURFACE CURRENTS

(75) Inventor: Alan E. Waltho, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/756,098

(22) Filed: Jan. 12, 2004

(65) Prior Publication Data

US 2005/0134522 A1 Jun. 23, 2005

Related U.S. Application Data

(63) Continuation-in-part of application No. 10/740,735, filed on Dec. 18, 2003, now abandoned.

(51) Int. Cl.
*H01Q 1/28* (2006.01)
*H01Q 15/02* (2006.01)

(52) U.S. Cl. ..... 343/705; 343/909

(58) Field of Classification Search ..... 343/700 MS, 343/756, 909, 795, 754, 911 R, 705
See application file for complete search history.

(56) References Cited

U.S. PATENT DOCUMENTS

| | | | | |
|---|---|---|---|---|
| 5,543,809 | A | 8/1996 | Profera, Jr. | |
| 5,579,024 | A | 11/1996 | Sureau | |
| 6,239,750 | B1 * | 5/2001 | Snygg | 343/700 MS |
| 6,262,495 | B1 | 7/2001 | Yablonovitvh et al. | |
| 6,411,261 | B1 | 6/2002 | Lilly | |
| 6,483,481 | B1 | 11/2002 | Sievenpiper et al. | |
| 6,498,587 | B1 | 12/2002 | Desclos et al. | |
| 6,512,494 | B1 | 1/2003 | Diaz et al. | |
| 6,525,695 | B2 | 2/2003 | McKinzie, III et al. | |
| 6,552,687 | B1 * | 4/2003 | Rawnick et al. | 343/700 MS |
| 6,690,327 | B2 * | 2/2004 | McKinzie et al. | 343/700 MS |
| 6,774,866 | B2 | 8/2004 | McKinzie, III et al. | |
| 6,952,190 | B2 * | 10/2005 | Lynch et al. | 343/909 |
| 2002/0167456 | A1 * | 11/2002 | McKinzie, III | 343/909 |
| 2003/0076276 | A1 | 4/2003 | Church et al. | |
| 2003/0142036 | A1 * | 7/2003 | Wilhelm et al. | 343/909 |
| 2004/0075617 | A1 * | 4/2004 | Lynch et al. | 343/909 |
| 2004/0119658 | A1 | 6/2004 | Waltho | |

OTHER PUBLICATIONS

Sievenpiper et al., "High-Impedance Electromagnetic Surfaces with a Forbidden Frequency Band", IEEE Trans.'s on Microwave Theory . . . , vol. 47, No. 11, Nov. 99, pp. 2059-2074.
McKinzie III, et cl., "Mitigation of Multipath Through the use of an Artificial Magnetic Conductor for Precision GPS Surveying Antennas", 2002 IEEE, pp. 640-643.

* cited by examiner

*Primary Examiner*—Shih-Chao Chen
*Assistant Examiner*—Minh Dieu A
(74) *Attorney, Agent, or Firm*—Stuart A. Whittington; Anthony M. Martinez

(57) ABSTRACT

Briefly, in accordance with an embodiment of the invention, an apparatus to suppress surface currents is provided. The apparatus may include very high frequency (VHF) antenna and a frequency selective surface (FSS) structure adjacent to the VHF antenna. The FSS structure may include a ground plane, a first conductive via coupled to the ground plane, and a first conductive plate coupled to the first conductive via, wherein the FSS structure has a band gap frequency in the VHF band.

26 Claims, 6 Drawing Sheets

FREQUENCY SELECTIVE SURFACE TO SUPPRESS SURFACE CURRENTS

CROSS-REFERENCE TO RELATED APPLICATIONS

This patent application is a Continuation-in-part application, and claims priority under 35 U.S.C. § 120, to copending U.S. application Ser. No. 10/740,735 (now abandoned) filed on Dec. 18, 2003 by the same inventors.

BACKGROUND

Currently the United States Federal Aviation Administration (FAA) prohibits the use of intentional radiators (e.g., cellular phones, WLANs, two way pagers) at any time that the aircraft is in flight or preparing for flight. Unintentional radiators (e.g., personal computers, PDAs) may be used at the discretion of the pilot when the aircraft is 10,000 feet or more above ground level. This is due in part to possible issues of interference caused to aircraft systems by these electronic devices. Accordingly, manufacturers of electronic devices and aircraft operators are motivated to find ways to alleviate this potential problem.

BRIEF DESCRIPTION OF THE DRAWINGS

The subject matter regarded as the invention is particularly pointed out and distinctly claimed in the concluding portion of the specification. The present invention, however, both as to organization and method of operation, together with objects, features, and advantages thereof, may best be understood by reference to the following detailed description when read with the accompanying drawings in which:

Figure 1:
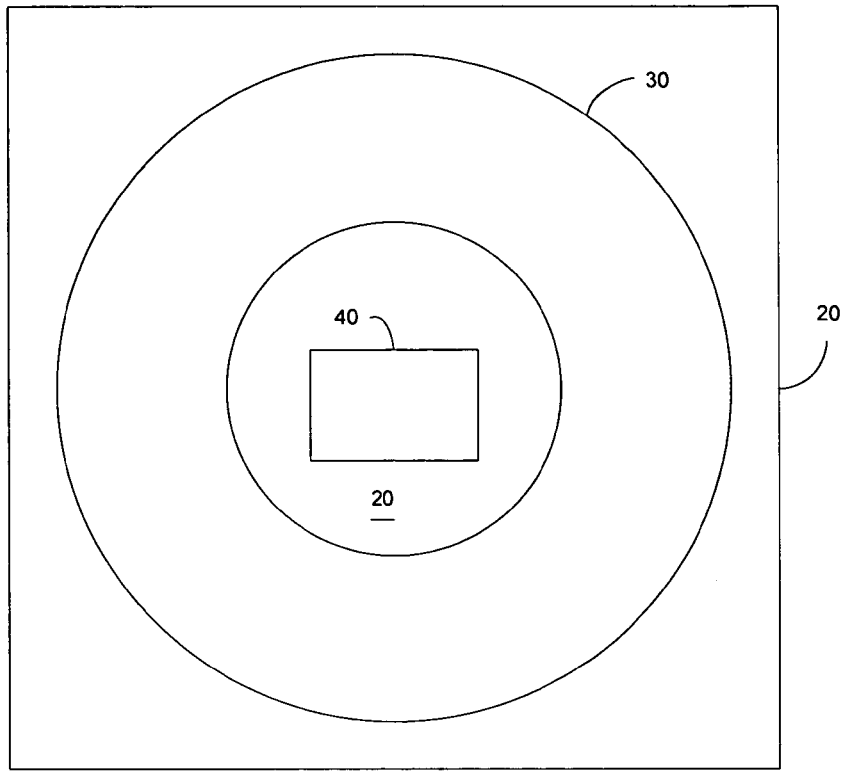
FIG. 1 is a diagram illustrating a wireless structure in accordance with one embodiment of the present invention.

It will be appreciated that for simplicity and clarity of illustration, elements illustrated in the figures have not necessarily been drawn to scale. For example, the dimensions of some of the elements are exaggerated relative to other elements for clarity. Further, where considered appropriate, reference numerals have been repeated among the figures to indicate corresponding or analogous elements.

DETAILED DESCRIPTION

In the following detailed description, numerous specific details are set forth in order to provide a thorough understanding of the present invention. However, it will be understood by those skilled in the art that the present invention may be practiced without these specific details. In other instances, well-known methods, procedures, components and circuits have not been described in detail so as not to obscure the present invention.

In the following description and claims, the terms "include" and "comprise," along with their derivatives, may be used, and are intended to be treated as synonyms for each other. In addition, in the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other.

The terms "over" and "overlying," may be used and are not intended as synonyms for each other. In particular embodiments, "overlying" may indicate that two or more elements are in direct physical contact with each other, with one on the other. "Over" may mean that two or more elements are in direct physical contact, or may also mean that one is above the other and that the two elements are not in direct contact.

The following description may include terms, such as over, under, upper, lower, top, bottom, etc. that are used for descriptive purposes only and are not to be construed as limiting. The embodiments of an apparatus or article of the present invention described herein can be manufactured, used, or shipped in a number of positions and orientations.

FIG. 1 is a diagram illustrating a wireless structure 10 in accordance with one embodiment of the present invention. Wireless structure 10 may include a base 20, a frequency selective surface (FSS) 30, and an antenna 40.

In one embodiment, antenna 40 may be an aircraft very high frequency (VHF) antenna. VHF is the radio frequency range from 30 megahertz (MHz) (wavelength 10 meters) to 300 MHz (wavelength 1 m). In one example, antenna 40 is an aircraft VHF communications antenna having a frequency of operation ranging from about 118 MHz to about 137 MHz. In other words, antenna 40 may be a VHF communications antenna coupled to receive radio frequency (RF) signals having a carrier frequency ranging from about 118 megahertz (MHz) to about 137 MHz. The VHF communications antenna may be used in an aircraft's VHF communications system which is used for air traffic control communications. In another example, antenna 40 is an instrument landing system (ILS) aircraft antenna or a VOR aircraft antenna having a frequency of operation ranging from about 108 MHz to about 118 MHz. Both the ILS and VOR antennas may be receive only antennas coupled ILS and VOR navigation and landing aid systems of an aircraft. VOR may refer to Very High Frequency Omnirange that allows the range to a ground based beacon to be determined. In these embodiments, antenna 40 may be a monopole antenna made of aluminum and may be triangular or trapezoidal-shaped.

In the embodiment where antenna 40 is an aircraft antenna, base 20 may be the fuselage of the aircraft, wherein FSS 30 and antenna 40 are coupled to the fuselage. As is shown in FIG. 1, FSS 30 may be circular. In addition, FSS 30 may be curved or conformal to the surface of the fuselage. In one embodiment, FSS 30 may include a plurality of conductive patches arranged over a top surface of a dielectric material in a cyclical pattern. In this embodiment, FSS 30 may also include a ground plane over a bottom surface of the dielectric material, wherein the conductive patches are coupled to a ground plane by a conductive via.

According to some reports, it is possible that electronic devices such as FM radios, cellular phones, personal digital assistants (PDA), or portable personal computers (PCs) operated within an aircraft may provide interference to aircraft ILS, VOR, and VHF communication systems. Emissions from the electronics devices within an aircraft may couple through the windows to the external surface of the fuselage, thereby creating RF surface currents. These surface currents may also be referred to as inhomogeneous plane waves, and may cause interference problems with the external avionic communication and navigation antennas of the aircraft. In accordance with an embodiment of the present invention, FSS 30 may be coupled to the fuselage adjacent to antenna 40, and may suppress undesirable surface currents, thereby mitigating or eliminating interference problems and allowing the use of electronic devices within the aircraft by passengers.

Examples of FSS 30 are discussed below. Generally, FSS 30 is a structure that may conduct direct currents (DC) but may reduce or suppress alternating currents (AC) within a particular frequency range. In other words, FSS 30 may be formed or manufactured in a way to prevent propagation of radio frequency (RF) surface currents within a frequency band gap. This band gap frequency range may be referred to as a "forbidden frequency band." The band gap of FSS 30 may also be referred to as the resonant frequency of FSS 30. In some applications, FSS 30 may also be referred to as a high impedance surface or an artificial magnetic conductor (AMC).

Generally, the band gap or forbidden frequency band of FSS 30 may be altered by altering the size of FSS 30. In particular, altering the thickness of FSS 30 or the size of some of the components of FSS 30 may alter the band gap of FSS 30.

FSS 30 may be positioned adjacent to antenna 40 to lessen or suppress RF surface currents in the VHF band from propagating along the conductive back plane of FSS 30. In one example, FSS 30 may be spaced apart from antenna 40 by about 45 centimeters (cm) to about 200 cm. Placing FSS 30 adjacent to antenna 40 may reduce or eliminate interference from electronic devices located within the aircraft.

Surface current mitigation may be used to achieve a high impedance surface at the frequency of interest. Surface currents may propagate on smooth metal surfaces until they are scattered by discontinuities in the surface texture. By creating a high impedance surface near an antenna, the intrusive surface currents may not propagate, thereby ceasing to cause interference to the antenna. Several techniques may be used to isolate antennas from these surface currents. For example, choke rings or corrugated slabs may be used to suppress or mitigate surface currents, however, these structures may be relatively large in size since they must be a quarter-wavelength ($\lambda/4$) thick to effectively suppress surface currents. For VHF antennas, this implies that the choke rings or corrugated slabs be about 0.5 meters (m) thick to meet the quarter-wavelength requirement. Such a relatively large structure attached to the fuselage of an aircraft may not be practical due to the drag it would create for the aircraft. A choke ring is a structure comprised of a plurality of concentric rings.

FSS 30 may have a relatively small profile and may be much smaller than $\lambda/4$. Examples discussed below provide FSS structures that may be used with VHF antennas and have thicknesses ranging from about 0.5 centimeters (cm) to about 1.3 cm. An FSS having a thickness ranging between about 0.5 cm to about 1.3 cm may be coupled to the fuselage of an aircraft and present negligible drag and may reduce surface currents by up to about 30 dB.

Figure 2:
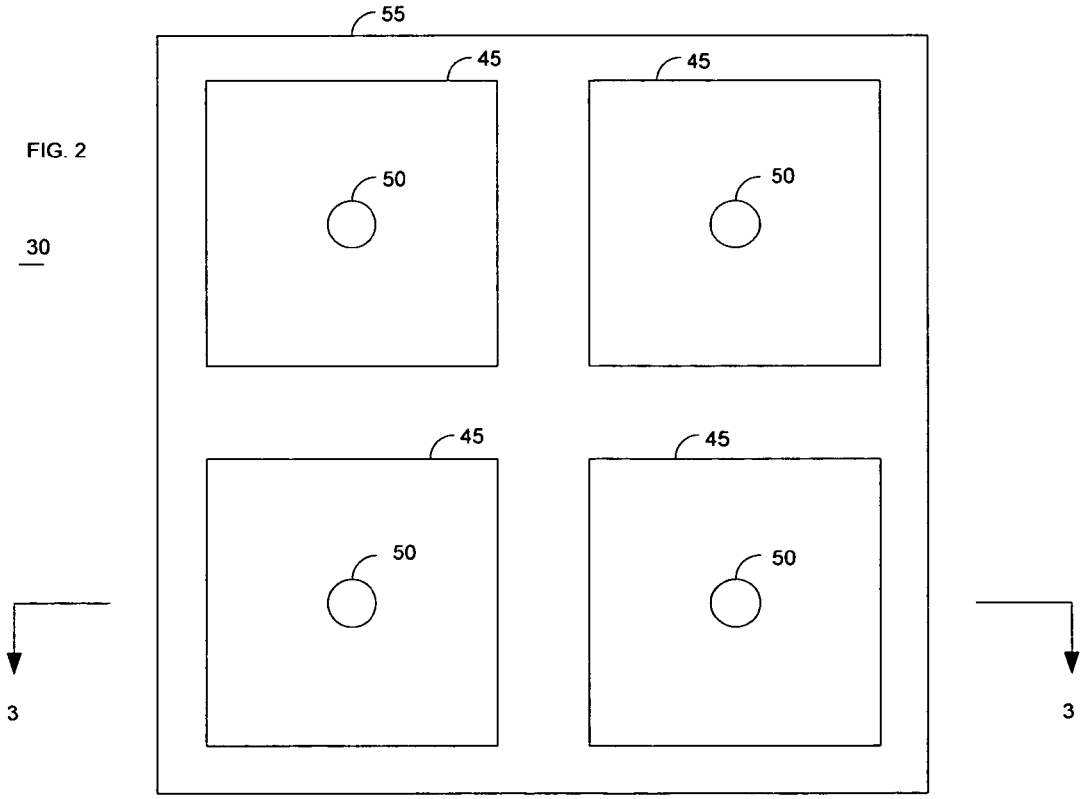
FIG. 2 is a top view illustrating a portion of a frequency selective surface structure in accordance with an embodiment of the present invention.

An embodiment of FSS 30 is illustrated in FIG. 2. FIG. 2 is a top view illustrating a portion of FSS 30 in accordance with an embodiment of the present invention. In this embodiment, FSS 30 may include a plurality of conductive patches 45, conductive vias 50, and a ground plane 55.

Figure 3:
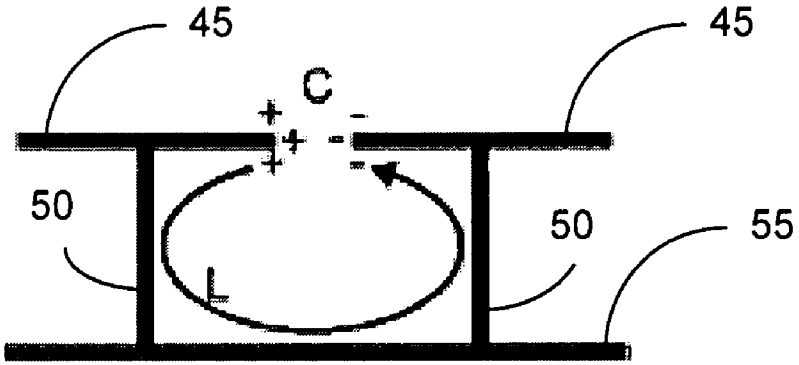
FIG. 3 is a cross-sectional view of the structure of FIG. 2 through line 3—3.

FIG. 3 is a cross-sectional view of the structure illustrated in FIG. 2 through section line 3—3. As is illustrated in FIG. 3, vias 50 may be coupled at one end to ground plane 55 and at the other end to conductive patches 45. FSS 30 may further include an electrically insulating or dielectric material (not shown in FIGS. 2 and 3) sandwiched between ground plane 55 and conductive patches 45. Examples of the dielectric material may include a fiber reinforced polymer or a copper laminate epoxy glass (e.g., FR4). In another embodiment, the dielectric material may be a dielectric layer that incorporates ionizing particles. For example, an ionizing material may be formed within a dielectric layer. In this embodiment, the ionizing material may become ionized in the event of a lightning strike, and conduct current to ground since conductive vias 50 alone may not be sufficient to carry the high current.

Conductive vias 50 may also be referred to as posts, poles, pillars, or columns, and ground plane 55 may also be referred to as a conductive back plane. Conductive patches 45 may also be referred to as conductive elements, plates, or pads. In the embodiment illustrated in FIG. 2, conductive patches 45 may be substantially square-shaped, although the scope of the present invention is not limited in this respect. In other embodiments, conductive patches 45 may be substantially rectangular, triangular, hexagonal, circular or irregularly shaped.

As is illustrated in FIG. 3, FSS 30 may effectively be considered a lumped circuit element modeled by a second order LC resonance circuit. A capacitive element or capacitor may be formed using conductive patches 45 and ground plane 55. For example, conductive patches 45 may form the upper plate of a capacitor and ground plane 55 may form the lower plate of the capacitor. As may be appreciated, at least four capacitors are illustrated for FSS 30 in FIG. 2, wherein ground plane 55 serves as a common lower plate of these four capacitors. These capacitors may be referred to as printed capacitors since their upper and lower plates may be formed by patterning a conductive material such as, for example, copper.

Conductive patches 45 may be coupled to ground plane 55 by inductive vias 50. The LC resonance of FSS 30 may enable a zero degree phase shift at its resonant frequency. This effectively emulates free space, where surface currents are not supported. Because of its ability to suppress surface currents, FSS 30 may be effective in mitigating interference at a particular frequency of interest, e.g., in the VHF band.

Referring to FIGS. 2 and 3, in one embodiment, FSS 30 may be formed by forming a layer of a conductive material such as, for example, copper, overlying a top surface of a dielectric material. The conductive layer may be bonded to the top surface of the dielectric material using, e.g., an adhesive. The conductive layer may be patterned using, for example, an etch process to form the plurality of conductive patches 45. Similarly, a layer of conductive material such as, for example, copper, may be formed overlying and adhesively bonded to a bottom surface of the dielectric layer to form ground plane 55.

In one embodiment, after patterning the conductive layer on the top surface of a dielectric layer to form conductive patches 45, holes (not shown) may be formed in the dielectric layer. These holes may be filled or plated with an electrically conductive material such as, for example, copper, to form conductive vias 50. Alternatively vias may be formed by aluminum rivets attaching the FSS material to the aircraft fuselage. Vias 50 may be formed at least between the top and bottom surfaces of the dielectric material, and may be formed so that one end of a via 50 is planar with an exposed surface of conductive patch 45 and so that the other end of via 50 is planar with an exposed surface of ground plane 55. Vias 50 may also be formed at the geometric centers of conductive patches 45 or may be formed off-center.

One embodiment of an FSS 30 that may be placed on a aircraft fuselage adjacent to aircraft ILS, VOR, or VHF communications antennas is discussed as follows. In this embodiment, FSS 30 may have a thickness ranging from about 0.5 cm to about 1.3 cm. Vias 50 may have a length approximately equal to the thickness of the dielectric material, e.g., the length of conductive via 50 and the dielectric material may range from about 0.5 cm to about 1.3 cm. The diameter of conductive via 50 may be about 0.16 cm.

The thickness of ground plane 55 may be about 0.005 cm and the thickness of conductive patches 45 may also be about 0.005 cm. The length and width of conductive patches 45 may be about 3.8 cm to form a 3.8 cm×3.8 cm square, and conductive patches 45 may be spaced apart from each other by about 0.05 cm.

Accordingly, FSS 30 may be placed adjacent to a VHF antenna and tuned to the operating frequency of the VHF antenna. Tuning FSS 30 may refer to adjusting or sizing the thickness of FSS 30 and the surface area or volume of conductive patches 45 to alter the LC characteristics of FSS 30 to suppress radio frequency (RF) surface currents in the VHF band from propagating along ground plane 55.

In one embodiment, FSS 30 may be placed adjacent to an aircraft VHF communications antenna. In this embodiment, FSS 30 may have a band gap frequency centered at about 127 MHz and ranging from about 118 MHz to about 137 MHz. In another embodiment, FSS 30 may be placed adjacent to an aircraft ILS or VOR antenna. In this embodiment, FSS 30 may have a band gap frequency centered at about 113 MHz and ranging from about 108 MHz to about 118 MHz. Although FSS 30 has been described in some embodiments as being placed adjacent aircraft antennas, this is not a limitation of the present invention. In other embodiments, FSS 30 may be placed adjacent to non-aircraft antennas.

In an alternate embodiment, FSS 30 may be a flexible structure attached to the fuselage of an aircraft by rivets, wherein the rivets replace the conductive vias 50 and serve as the inductive elements of FSS 30. Using rivets in place of conductive vias 50 to attach FSS 30 to the fuselage may eliminate ground plane 50, wherein the fuselage may serve as the ground plane of FSS 30.

Figure 4:
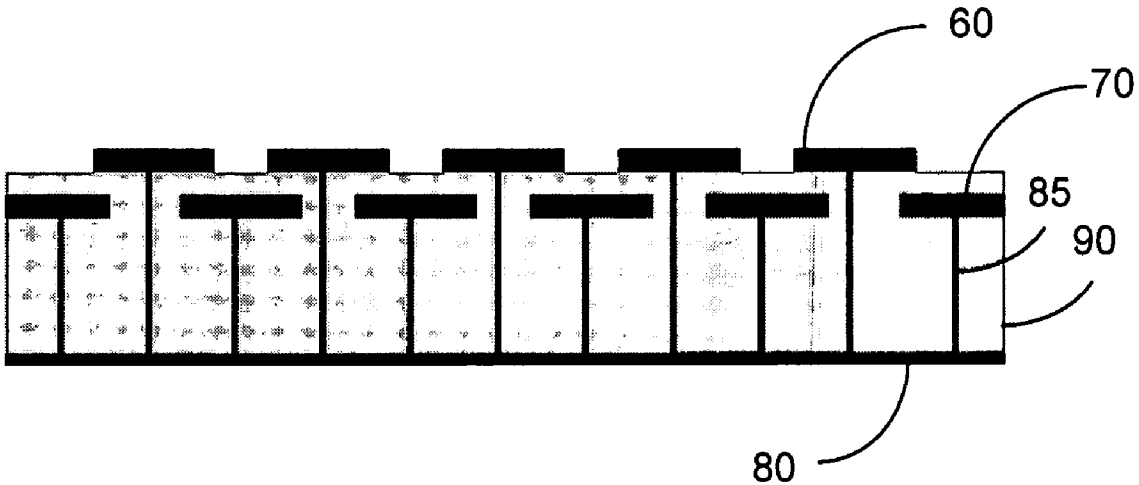
FIG. 4 is a cross-sectional view of a portion of a frequency selective surface structure in accordance with an embodiment of the present invention.

FIG. 4 is a cross-sectional view of another embodiment of FSS 30. In this embodiment, FSS 30 may include conductive patches 60 and 70, a ground plane 80, conductive vias 85, and a dielectric material 90.

Further, in this embodiment, FSS 30 may be realized by three metal layers 60, 70, and 80, whereby the top layers 60 and middle layers 70 are shifted replicas of each other, achieving capacitive loading through overlap capacitance. This may reduce the resonant frequency of FSS 30 and may also reduce bandwidth of the bad gap frequency of FSS 30. This structure may be fabricated at low cost using PC board manufacturing. In one embodiment, FSS 30 may have a thickness ranging from about 0.5 cm to about 1.3 cm. Alternatively the structure may be fabricated using a flexible laminate that may be easily shaped to follow the curvature of the aircraft fuselage. In this case the conductive vias may be formed by flush rivets in place of the plated holes.

Figure 5:
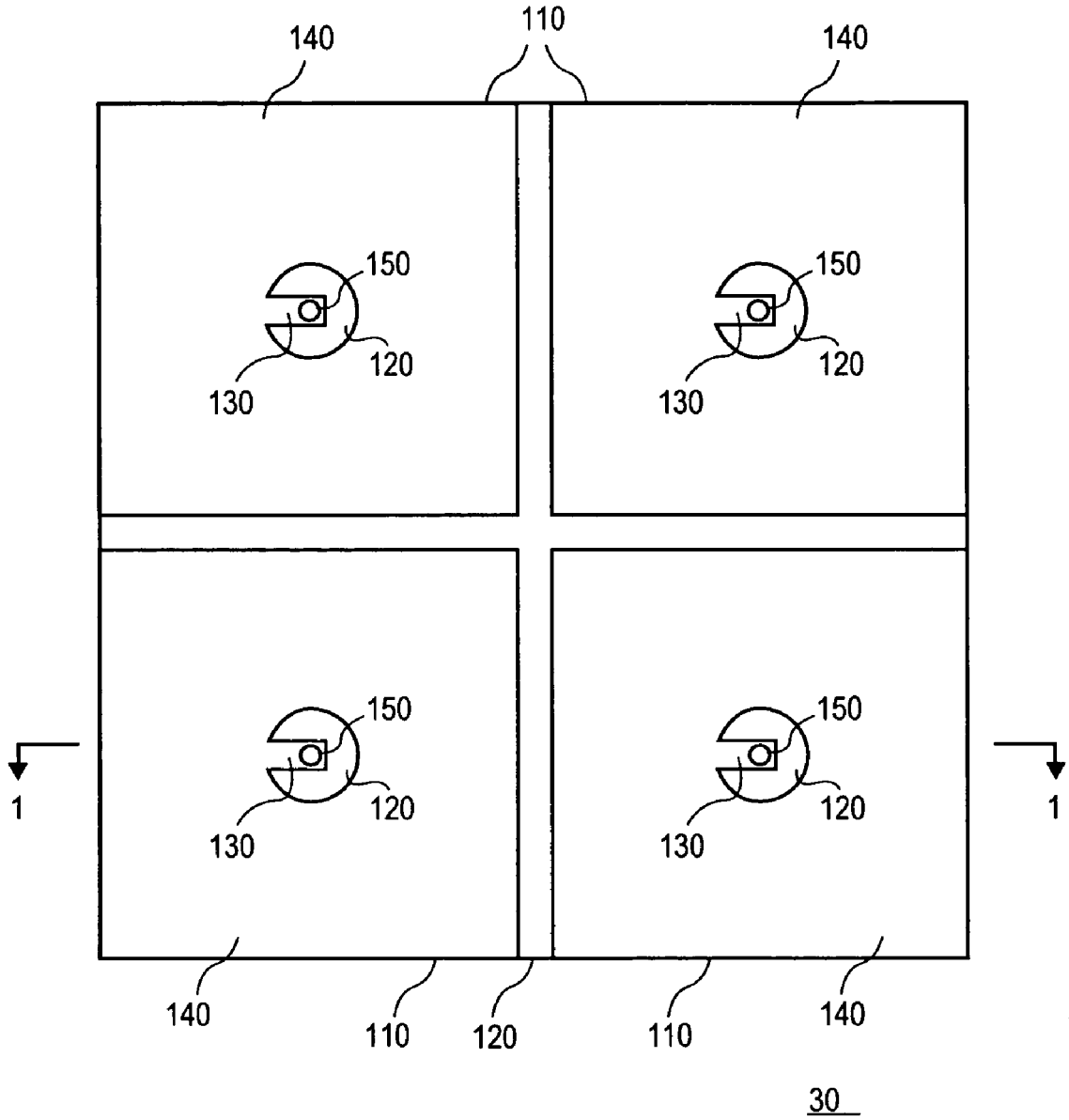
FIG. 5 is a top view illustrating a portion of a frequency selective surface structure in accordance with an embodiment of the present invention.

FIG. 5 is a top view illustrating a portion of FSS 30 in accordance with an embodiment of the present invention. In this embodiment, FSS 30 may include patterned conductive materials 110 over a top surface of a dielectric material 120, wherein each of the patterned conductive materials 110 include an inductor 130 and a conductive plate 140, wherein conductive plate 140 is connected to inductor 130. Conductive plate 140 may form one plate of a parallel plate capacitor.

Figure 6:
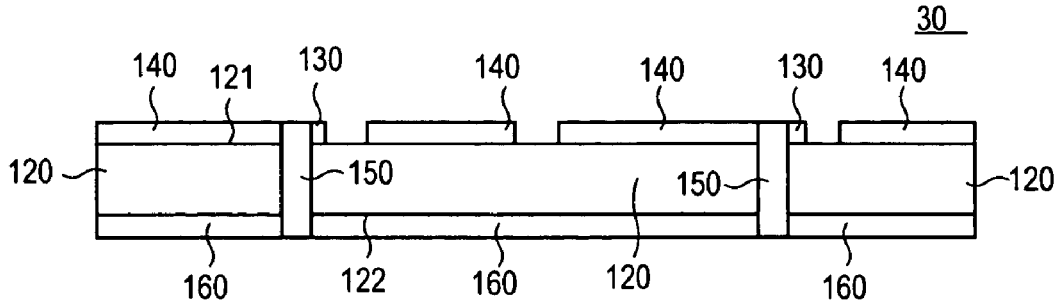
FIG. 6 is a cross-sectional view of the structure of FIG. 5 through line 1—1.

FIG. 6 is a cross-sectional view of the structure illustrated in FIG. 5 through section line 1—1. FSS 30 may further include conductive vias 150 formed in dielectric material 120. In one embodiment, vias 150 are physically separated from each other and are formed extending between at least a top surface 121 and a bottom surface 122 of dielectric material 120. FSS 30 may further include an electrically conductive plate 160 overlying surface 122 of dielectric material 120.

In one embodiment, dielectric material 120 may be a dielectric substrate. Although the scope of the present invention is not limited in this respect, dielectric material 120 may be any material suitable for a printed circuit board substrate such as a fiber reinforced polymer or a copper laminate epoxy glass (e.g., FR4). In addition, dielectric material 120 may include ionizing particles, although the scope of the present invention is not limited in this respect.

FSS 30 may be formed by forming a layer of a conductive material such as, for example, copper, overlying surface 122 of dielectric material 120 to form conductive plate 160. An adhesive may be used to bond conductive plate 160 to surface 122. Similarly, a layer of conductive material such as, for example, copper, may be formed overlying and adhesively bonded to surface 121 of dielectric material 120. This conductive layer on surface 121 may be a single layer or multiple layers of conductive material and may be patterned using, for example, an etch process, to form inductors 130 and conductive plates 140.

In one embodiment, after patterning the conductive layer on surface 121, holes (not shown) may be formed in dielectric material 120. These holes may be filled or plated with an electrically conductive material such as, for example, copper, to form conductive vias 150. Vias 150 may be formed at least between surfaces 121 and 122 of dielectric material 120, and may be formed so that one end of a via 150 is planar with an exposed surface of inductor 130 and so that the other end of via 150 is planar with an exposed surface of conductive plate 160. Vias 150 may also be formed at the geometric centers of conductive plates 140 or may be formed off-center. In one embodiment, via 150 may have a length approximately equal to the thickness of dielectric material 120 and a diameter of about 0.16 cm. Although the scope of the present invention is not limited in this respect, the thickness of FSS 30 in this embodiment may range from about 0.5 cm to about 1.3 cm.

In one embodiment, inductors 130 are substantially rectangular-shaped conductors, each having a length of about 1 centimeter to about 1.5 centimeters and a width of about 0.1 to 0.3 centimeters. The thickness of conductive plate 160 may be about 0.005 cm and the thickness of conductive plate 140 and inductor 130 may both be about 0.005 cm to about 0.0125 cm. The thickness of dielectric material 120 and the length of via 150 may both range from about 0.5 cm to about 1.3 cm.

Conductive plate 160 may serve as a conductive ground plane. A capacitive element or capacitor may be formed using conductive plates 140 and 160. For example, conductive plate 140 may form the upper plate of a capacitor and conductive plate 160 may form the lower plate of the capacitor. As may be appreciated, at least four capacitors are illustrated in FSS 30 illustrated in FIGS. 5 and 6, wherein conductive plate 160 serves as a common lower plate of these four capacitors. These capacitors may be referred to as printed capacitors since their upper and lower plates may be formed by patterning a conductive material.

In the embodiment illustrated in FIG. 5, conductive plates 140 may be substantially square-shaped, although the scope of the present invention is not limited in this respect. In other embodiments, conductive plates 140 may be substantially rectangular, triangular, hexagonal, circular or irregularly shaped.

Inductors 130 formed overlying surface 121 may be referred to as printed inductors, inductive strips, or strip inductors. Inductor 130 may be formed between conductive plate 140 and conductive via 150. In addition, inductor 130 and via 150 may be formed so that a portion of inductor 130 surrounds an upper end of via 150, although the scope of the present invention is not limited in this respect. Further, printed inductor 130 and conductive via 150 may be formed substantially at the geometric center of conductive plate 140.

In the embodiment illustrated in FIG. 5, inductors 130 may be formed by patterning a single layer of conductive material and may be substantially rectangular-shaped, straight conductors having no turns, although the scope of the present invention is not limited in this respect. In other embodiments, inductor 130 may be a coil having at least a partial turn, e.g., one turn, or have a spiral shape as is shown in the embodiment illustrated in FIG. 9. Altering the shape and length of inductor 130 may alter the inductance of inductor 130.

FSS 30 may be coupled or in close proximity to an antenna or multiple antennas such as, for example, VHF antennas. In this example, FSS 30 may have an equivalent circuit of multiple coupled resonant circuits formed from inductors 140, vias 150, and conductive plates 140 and 160. Each resonant circuit may include an inductive element and a capacitive element, wherein the inductive element includes inductor 130 and conductive via 150. The capacitive element may include conductive plates 140 and 160.

The resonance or resonant frequency may be the frequency where the reflection phase passes through zero. At this frequency, a finite electric field may be supported at the surface of conductive plate 160, and an antenna or multiple antennas may be placed adjacent to the surface without being shorted out. The bandwidth of the band gap frequency of FSS 30 may be altered by adjusting the inductance: capacitance (L:C) ratio of the resonant circuits. For example, the bandwidth may be increased by increasing the inductance and decreasing the capacitance.

The bandwidth of the band gap frequency of FSS 30 may be increased by altering the inductance of the inductive elements. In the embodiment illustrated in FIGS. 5 and 6, inductors 130 are serially connected to via 150, and therefore, the length of vias 150 and/or the length of inductors 130 may be increased to increase the inductance of the resonant circuits, thereby increasing the bandwidth of the band gap. In this embodiment, the frequency of FSS 30 may also be lowered by using printed inductors to increase the value of the inductive component of the resonant circuit. Other methods for altering the frequency of FSS 30 may include altering the size of conductive plates 140 and/or altering the position of vias 150 relative to the center of capacitive plates 140. FSS 30 may also be referred to as a photonic band gap structure or an artificial magnetic conductor.

Figure 7:
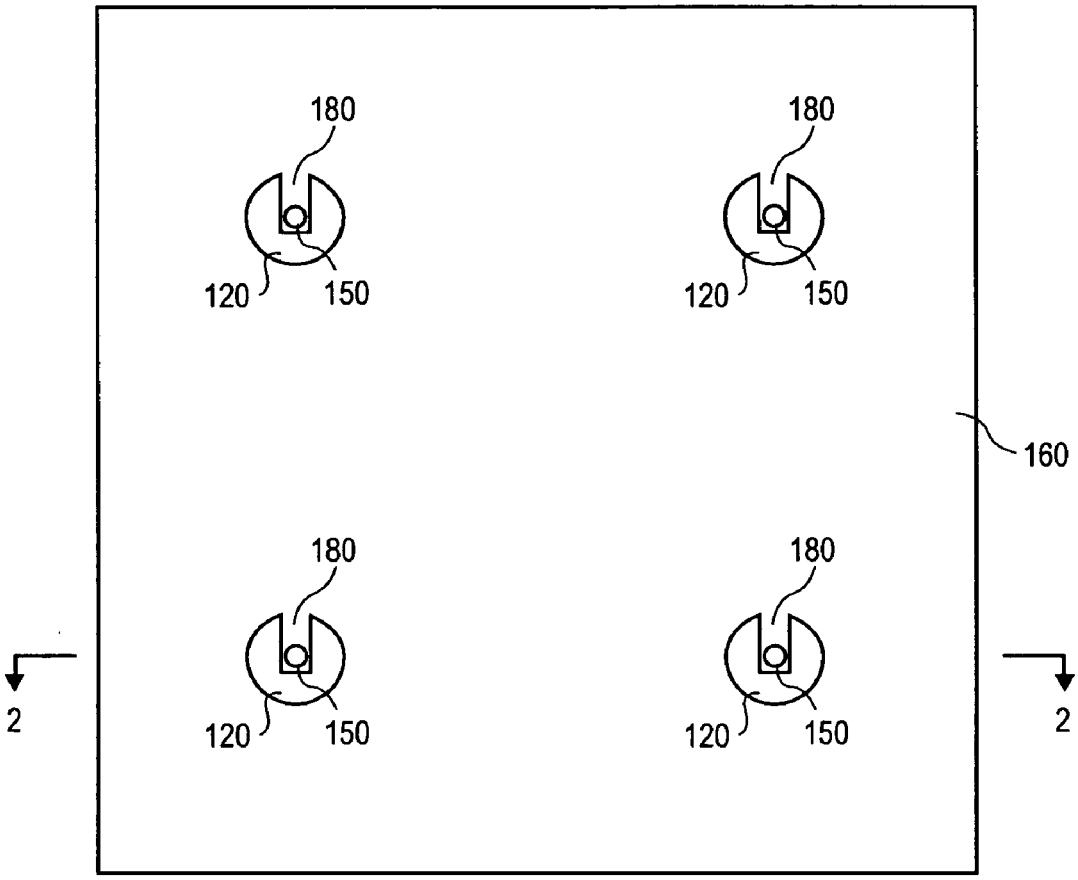
FIG. 7 is a bottom view illustrating a portion of a frequency selective surface structure in accordance with an embodiment of the present invention.
Figure 8:
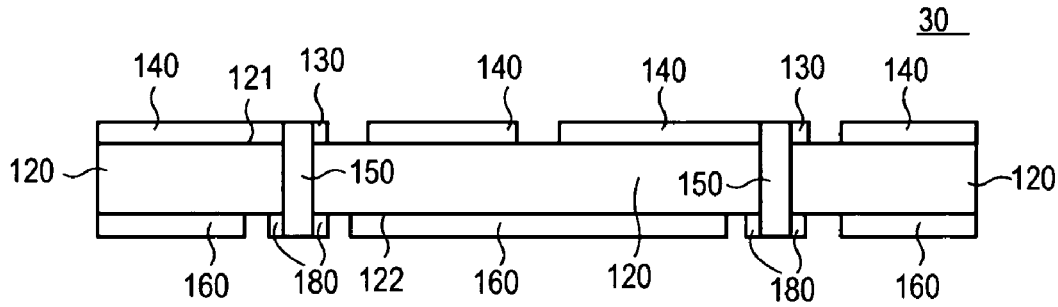
FIG. 8 is a cross-sectional view of the structure of FIG. 7 through line 2—2.

Turning to FIGS. 7 and 8, another embodiment of FSS 30 is illustrated. FIG. 7 illustrates a bottom view of FSS 30 and FIG. 8 illustrates a cross-sectional view of FSS 30 through section line 2—2. In this embodiment, printed inductors 180 may be formed overlying bottom surface 122 of dielectric material 120.

In this embodiment, inductors 180 may be connected between via 150 and conductive plate 160. Inductors 180 and conductive plate 160 may be formed by pattering a single layer of conductive material using, for example, an etch process. In this embodiment, vias 150 and inductors 130 and 180 form inductive elements of the resonant circuits of FSS 30. As may be appreciated, the inductance of the inductive element may be altered by including inductors 180 and altering the length of inductors 180.

Inductors 180 may be formed at substantially right angles (about 90 degrees) relative to inductors 130. By forming inductors 130 and 180 at right angles to each other, the fields due to the inductors may not cancel each other.

Figure 9:
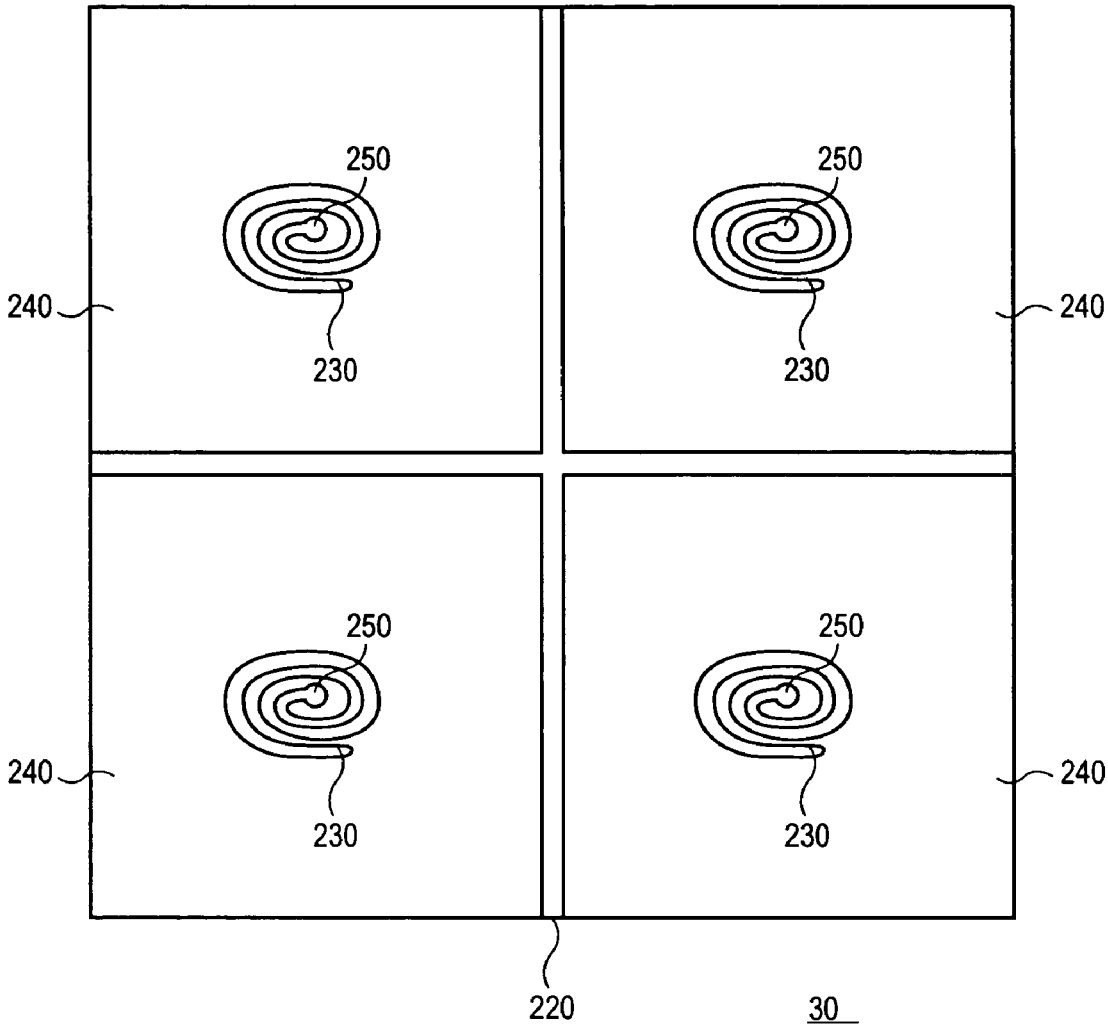
FIG. 9 is a top view illustrating a portion of a frequency selective surface structure in accordance with an embodiment of the present invention.

Turning to FIG. 9, a top view of FSS 30 in accordance with another embodiment is illustrated. FSS 30 may include conductive plates 240 overlying a dielectric material 220. FSS 30 may further include conductive vias 250 and inductors 230, wherein an inductor 230 may be connected between a via 250 and a conductive plate 240. Vias 250 may be formed in dielectric material 220 and may extend to a bottom surface (not shown) of dielectric material 220. FSS 30 may further include a ground plane (not shown) overlying the bottom surface of dielectric material 220.

In this embodiment, dielectric material 220, inductors 230, conductive plates 240, and vias 250 may be composed of the same or similar materials as dielectric material 120, inductors 130, conductive plates 140, and vias 150, respectively. A single layer of conductive material may be patterned using, for example, an etch process, to form inductors 230 and conductive plates 240. In the embodiment illustrated in FIG. 5, inductors 230 may be spiral-shaped.

In this embodiment, FSS 30 may have an equivalent circuit of multiple coupled resonant circuits formed from inductors 240, vias 250, conductive plates 240 and a ground plane (not shown in FIG. 5). Each resonant circuit may include an inductive element and a capacitive element, wherein the inductive element is formed by inductor 230 and via 250. The capacitive element may be formed by conductive plates 240 and the ground plane.

Figure 10:
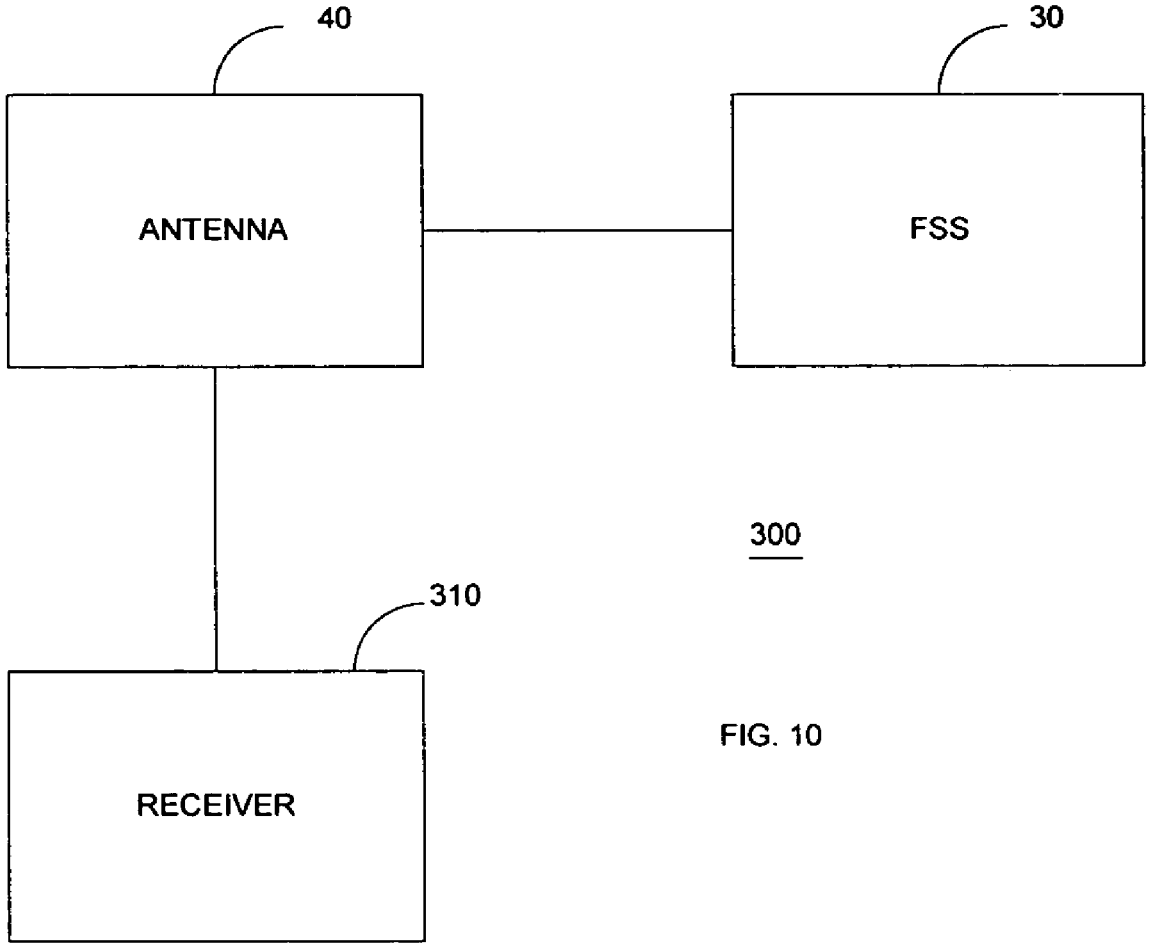
FIG. 10 is block diagram illustrating a portion of a system in accordance with an embodiment of the present invention.

Turning to FIG. 10, is a block diagram illustration a portion of a system 300 in accordance with an embodiment of the present invention. In this embodiment, system 300 may include antenna 40 and FSS 30. In addition, system 300 may include a wireless receiver 310 coupled to receive RF signals from antenna 40. Wireless receiver 310 may be coupled to antenna 40 using, for example, a coax cable, wherein the outer mesh conductor of the coax cable is coupled to the ground plane of FSS 30.

In one embodiment, system 300 may be an aircraft very high frequency (VHF) communications system. In this embodiment, antenna 40 may be an aircraft VHF communications antenna coupled to receive radio frequency (RF) signals having a carrier frequency ranging from about 118 megahertz (MHz) to about 137 MHz. Wireless receiver 310 may be part of the aircraft VHF communications system and may be coupled to receive the RF signals from antenna 40.

In another embodiment, system 300 may be an aircraft navigation or landing aid system such, for example, of an aircraft instrument landing system (ILS) or an aircraft Very High Frequency Omnirange (VOR) system. In this embodiment, antenna 40 may be an aircraft ILS or VOR antenna coupled to receive radio frequency (RF) signals having a carrier frequency ranging from about 108 megahertz (MHz) to about 118 MHz. Wireless receiver 310 may be part of the aircraft ILS or VOR system and may be coupled to receive the RF signals from antenna 40.

While certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

The invention claimed is:

1. An apparatus, comprising:

a very high frequency (VHF) aircraft antenna; and a frequency selective surface (FSS) structure adjacent to the VHF antenna, wherein the FSS structure includes:

a ground plane;

a first conductive via coupled to the ground plane;

a first conductive plate coupled to the first conductive via, wherein the FSS structure has a band gap frequency in the VHF band; and a dielectric material between the first conductive plate and the ground plane, wherein the first conductive plate is formed overlying a first surface of the dielectric material and the ground plane is formed overlying a second surface of the dielectric material; and a printed inductor overlying the first surface of the dielectric material and coupled to the conductive plate and the first conductive via.

2. The apparatus of claim 1, wherein the band gap frequency of the FSS structure ranges from about 108 MHz to about 118 MHz.

3. The apparatus of claim 1, wherein the band gap frequency of the FSS structure ranges from about 118 MHz to about 137 MHz.

4. The apparatus of claim 1, wherein the band gap frequency of the FSS structure is centered at about 113 MHz.

5. The apparatus of claim 1, wherein the band gap frequency of the FSS structure is centered at about 127 MHz.

6. The apparatus of claim 1, wherein the dielectric material includes ionizing particles.

7. The apparatus of claim 1, wherein the FSS structure has a thickness ranging from about 0.5 centimeters (cm) to about 1.3 cm.

8. The apparatus of claim 1, wherein a first end of the first conductive via is coupled to the first conductive plate and a second end of the first conductive via is coupled to the ground plane and wherein the first conductive via has a length ranging from about 0.5 centimeters (cm) to about 1.3 cm and a diameter of about 0.16 cm.

9. The apparatus of claim 1, wherein the ground plane has a thickness of a about 0.005 centimeters (cm), the first conductive plate is substantially square-shaped, and the first conductive plate has a thickness of about 0.005 cm, a length of about 3.8 cm, and a width of about 3.8 cm.

10. The apparatus of claim 1, wherein the first conductive plate is substantially square-shaped, rectangular, triangular, hexagonal, or circular.

11. An apparatus, comprising:

a very high frequency (VHF) antenna aircraft and a frequency selective surface (FSS) structure adjacent to the VHF antenna, wherein the FSS structure includes:

a ground plane;

a first conductive via coupled to the ground plane; and a first conductive plate coupled to the first conductive via, wherein the FSS structure has a band gap frequency in the VHF band;

a dielectric material between the first conductive pin and the ground plane, wherein the first conductive plate is formed overlying a first surface of the dielectric material and the ground plane is formed overlying a second surface of the dielectric material; and a first printed inductor overlying the first surface of the dielectric material and coupled to the first conductive plate and the first conductive via, wherein the first printed inductor and the first conductive via are formed substantially at the geometric center of first conductive plate.

12. The apparatus of claim 11, wherein the first printed inductor is a substantially rectangular-shaped conductor having a length of about 1 to about 1.5 centimeters, a width of about 0.1 to 0.3 centimeters, and a thickness of about 0.005 to about 0.0125 centimeters.

13. The apparatus of claim 11, wherein the first printed inductor and the first conductive plate are formed by patterning a single layer of conductive material.

14. The apparatus of claim 11, wherein the first printed inductor is a coil having at least one turn.

15. The apparatus of claim 11, wherein the FSS structure further includes:

a second conductive plate overlying the first surface of the dielectric material and separated from the first conductive plate by about 0.05 cm;

a second conductive via having a first end formed substantially at the geometric center of second conductive plate and a second end coupled to the ground plane; and a second printed inductor overlying the first surface of the dielectric material and coupled to the second conductive plate and to the first end of the second conductive via, wherein the second printed inductor is formed substantially at the geometric center of second conductive plate.

16. An apparatus, comprising:

a very high frequency (VHF) aircraft antenna; and a frequency selective surface (FSS) structure adjacent to the aircraft antenna and tuned to the operating frequency of the aircraft antenna, wherein the FSS structure includes:

a conductive back plane;

a conductive column coupled to the conductive back plane;

a conductive pad coupled to the conductive column, wherein the thickness of the FSS structure and the surface area of the conductive pad are sized to suppress radio frequency (RF) surface currents in the VHF band from propagating along the conductive back plane;

a dielectric material between the conductive and the conductive back plane, wherein the conductive is formed overlying a first surface of the dielectric material and the conductive back plane is formed overlying a second surface of the dielectric material; and a printed inductor overlying the first surface of the dielectric material and coupled to the conductive pad and the conductive column, wherein the printed inductor and the conductive column are formed substantially at the geometric center of conductive pad.

17. The apparatus of claim 16, wherein the FSS structure has a thickness ranging from about 0.5 centimeters (cm) to about 1.3 cm.

18. The apparatus of claim 16, wherein the dielectric material includes ionizing particles.

19. A system, comprising:

an aircraft antenna coupled to receive radio frequency (RF) signals having a carrier frequency ranging from about 118 megahertz (MHz) to about 137 MHz; and a frequency selective surface (FSS) structure adjacent to the aircraft antenna that includes:

a ground plane;

a conductive via coupled to the ground plane;

a conductive plate coupled to the conductive via;

a dielectric material between the conductive pad and the conductive beck plane, wherein the conductive pad is formed overlying a first surface of the dielectric material and the conductive back plane is formed overlying a second surface of the dielectric material; and a printed inductor overlying the first surface of the dielectric material, wherein the FSS has a band gap frequency ranging from about 118 megahertz (MHz) to about 137 MHz.

20. The system of claim 19, further comprising a wireless receiver coupled to receive the RF signals from the aircraft antenna, and wherein the receiver is part of an aircraft very high frequency (VHF) communications system.

21. The apparatus of claim 19, wherein the FSS structure has a thickness ranging from about 0.5 centimeters (cm) to about 1.3 cm.

22. The apparatus of claim 19, wherein the dielectric material includes ionizing particles.

23. A system, comprising:

an aircraft antenna coupled to receive radio frequency (RF) signals having a carrier frequency ranging from about 108 megahertz (MHz) to about 118 MHz; and a frequency selective surface (FSS) structure adjacent to the aircraft antenna that includes:

a ground plane;

a conductive via coupled to the ground plane;

a conductive plate coupled to the conductive via; and a printed inductor coupled to the conductive plate, wherein the FSS has a band gap frequency ranging from about 108 megahertz (MHz) to about 118 MHz.

24. The system of claim 23, further comprising a wireless receiver coupled to receive the RF signals from the aircraft antenna, and wherein the receiver is part of an aircraft instrument landing system (ILS) or an aircraft Very High Frequency Omnirange (VOR) system.

25. The apparatus of claim 23, wherein the FSS structure has a thickness ranging from about 0.3 centimeters (cm) to about 1.3 cm.

26. The apparatus of claim 25, wherein the FSS structure further includes a dielectric material between the conductive plate and the ground plane, wherein the dielectric material includes ionizing particles.

* * * * *